US007731564B2

(12) United States Patent
Sanders

(10) Patent No.: US 7,731,564 B2
(45) Date of Patent: Jun. 8, 2010

(54) UNDERGARMENT WITH MEMORY FOAM INSERT

(76) Inventor: El L. Sanders, 11271 Ventura Blvd., Suite 136, Studio City, CA (US) 91604

( * ) Notice: Subject to any disclaimer, the term of this patent is extended or adjusted under 35 U.S.C. 154(b) by 0 days.

(21) Appl. No.: 12/171,272

(22) Filed: Jul. 10, 2008

(65) Prior Publication Data

US 2010/0005569 A1 Jan. 14, 2010

(51) Int. Cl.
*A41C 3/00* (2006.01)

(52) U.S. Cl. ..... 450/54; 450/39

(58) Field of Classification Search ..... 450/1, 450/36, 38, 39, 54–58, 92, 93, 60, 61, 66, 450/74, 75; 2/244, 246
See application file for complete search history.

(56) References Cited

U.S. PATENT DOCUMENTS 3,882,549 A * 5/1975 Gaburo ..... 2/244
4,217,905 A * 8/1980 Atwater et al. ..... 450/74
4,458,684 A * 7/1984 Frankel ..... 450/53
4,816,005 A 3/1989 Braaten
5,769,688 A 6/1998 Holliday
6,165,045 A 12/2000 Miller et al.
6,805,610 B2 10/2004 Luk
7,179,150 B2 2/2007 Luk et al.
7,192,332 B2 * 3/2007 Liu ..... 450/39
7,381,113 B2 * 6/2008 Hori ..... 450/55
7,442,110 B2 * 10/2008 Gaudet et al. ..... 450/39
2003/0181129 A1 9/2003 Getman
2005/0101221 A1 5/2005 Abbey et al.

* cited by examiner

*Primary Examiner*—Gloria Hale

(57) ABSTRACT

Disclosed is a use of a memory foam insert in bras, camisoles, shorts, and briefs. The memory foam insert is designed to limit and prevent the bouncing motion through the breast and gluteal area during rigorous athletic activity. The invention conforms and molds itself to the individual's shape and figure, thereby allowing for a comfortable and secure fit.

6 Claims, 4 Drawing Sheets

UNDERGARMENT WITH MEMORY FOAM INSERT

FIELD OF INVENTION

This invention relates generally to the field of body support for women. More specifically, this invention relates to supporting, contouring, and controlling the chest and gluteal areas through the use of undergarments with memory foam inserts.

BACKGROUND

Many women wear sports bras while engaging in athletic activities. These bras are specifically designed to withstand the increased wear and tear of exercise, and to support a woman's breasts while they are rapidly moving. In the past, sports bras and support garments had emphasized support, which consequently resulted in a tight fit and flattening of the chest. Some sports bras are not made of a breathable fabric. The present invention seeks to solve these problems, and in doing so, increase the comfort level of the user. The support garments mold themselves to the wearer's body, are breathable and fashionable.

There are several "no-bounce" or foam support undergarments that have previously received patents. None of these prior patents explicitly use memory foam to support the body and keep breasts or gluteals from bouncing. In fact, prior patents simply do not teach a product whose purpose is to use memory foam to support moving parts of the body.

Patents exist for bras with foam layers. U.S. Pat. No. 5,769,688, issued to Holliday, discloses a breast and chest protector comprised of a soft, rubberized foam exterior with a hard, high density plastic internal breast plate. Holliday primarily serves to protect female athletes from impacts caused by engaging in a high degree of bodily movement and physical contact. The function of the soft, rubberized foam exterior is to allow for adequate control of a ball in play, as may be required in soccer. U.S. Pat. Nos. 6,805,610 and 7,179,150, both issued to Luk et al, disclose a molded bra having a core of molded foam and a laminated second foam layer. The purpose of the invention is to reduce the amount of stitching on bras by providing a seamless breast cup construction. These patents are not designed to minimize the amount of bounce, nor do they have foam that molds itself to the body.

Patents exist for support bras designed to minimize bounce for large women. U.S. Pat. No. 4,816,005, issued to Braaten, discloses a sports bra for larger women. U.S. Pat. No. 6,165,045, issued to Miller et al, discloses a bra for large breasted, athletic women. Neither of these patents, however, uses memory foam for their support. Miller does have "molded foam," but rather, the lower half of the cup covering the wearer's breasts is molded from hot foam. It is not used to cover the entire breast area and shoulders as in the present invention, which uses memory foam throughout the area.

Two published patent applications disclose cushioning for sports bras. U.S. Pub. No. US 2003/0181129 A1, issued to Getman, discloses a bra pad whose cushioning material may be made out of polyurethane foam, rubber foam or PVC foam. U.S. Pub. No. US 2005/0101221 A1, issued to Abbey et al., discloses cushioning for the spine while performing floor activities such as Pilates. These applications provide cushioning, but do not particularly reduce movement.

Each of the previous prior art does not combine the no-bounce functionality, cushioning molded to the body, and a breathable fabric. As such, the prior art is limited in its comfort and quality.

The invention can be used by anyone ranging from females engaged in various athletic activities to those looking for everyday body support. The invention is designed to provide the ultimate in comfort, convenience, style, and form-fitting support.

SUMMARY OF THE INVENTION

The present invention is unique in that the support garment conforms and molds itself to the body of the wearer, has breathable fabric and does not flatten the supported area.

The fabric used in the invention is a preferably 90% micropoly/10% lycra quick dry functionality fabric, which can keep the user dry and comfortable. Any other stretchable fabric may also be used. The fabric consists of moisture wicks that provide fast evaporation and quickly draw wetness away from the user's skin. It provides both rapid moisture transport and moisture management.

The specialized foam insert is a technology that sculpts and contours to the body to eliminate the bouncing motion within the entire breast area during rigorous activity. Additionally, the insert is specifically designed to reduce the risk of muscle tissue breakdown and depreciation within the breast area.

In one embodiment, the invention comprises a support for the top of a woman's body. It may be in the form of a sports bra or a camisole.

The invention in the form of a sports bra is composed of a memory foam insert, base fabric, elastic band, contrasting trim or binding, stretchable mesh, tagless size and care instructions label and fabric strips, to further support and conceal the memory foam. The invention supports the breasts of a woman while she is engaged in various athletic activities. The memory foam insert is encased within the base fabric throughout the breast area. The foam is present throughout the entire front of the bra, including the immediate breast area and shoulder straps. The base fabric surrounds the foam insert. The unique base fabric has UV protection and an antibacterial treatment. This is true in all embodiments of the invention. The elastic band is designed to be comfortable, yet maintain a controlled fit. It supplies the extra stabilizing support for the breast to rest comfortably within the molding technology of the foam insert. It is located along the bottom portion of the bra, with its seam in the center back. The back of the support top is preferably composed of a ventilated single layer of stretchable mesh, which forms the back panel of the bra. The mesh is a breathable, stretchable, pliable, durable mini/micro mesh. The stretchable mesh is on the single layer racerback portion and also covers the base fabric on the side panels. The contrasting trim/binding is a one inch contrasting color fabric that trims the neck, arm hole and breast areas. The tagless size and care instructions label is centered on the inside of the back stretchable mesh panel. An overlock and cover stitch is used throughout the bra to bind the elements together. The fabric strip is a matching color fabric on top of the inside right and left side seams to cover, support, and prevent the foam from showing.

The invention in the form of a camisole is composed of a memory foam insert, base fabric, shelf bra, elastic band, shoulder straps, tagless size and care instructions label, and fabric strips to further support and conceal the memory foam. The memory foam insert is encased within the fabric of the shelf bra. The camisole is made of a single, solid color fabric throughout the front and back panel, with a shelf bra against the breast area. The shelf bra contains the memory foam insert, and supports the breasts. The elastic band is at the bottom of the shelf bra for additional support throughout the breast area. The shoulder straps are positioned at the top over the camisole, to go over the shoulders and toward the back of the camisole. They match the color of the camisole main fabric. The tagless size and care instructions label is centered at the top of the camisole's inside back. An overlock and cover stitch are used throughout the camisole to bind the elements of the camisole. The fabric strip is a matching color fabric on top of the inside right and left side seams of the bra to cover, support, and prevent the foam from showing.

In another embodiment, the invention comprises a support for the bottom of a user's body. It may be in the form of a boy short or brief.

A boy short is a larger piece of underwear that is designed to look like shorts. The invention in the form of a boy short is composed of a memory foam insert, base fabric, elastic band, tagless size and care instructions label, and mesh inserts. The memory foam insert is located within the rear and crotch areas of the shorts, to allow for padding when bicycling, rock climbing, and engaging in other rigorous activity. The boy short is made of a breathable fabric. The elastic band is located at the top of the boy short, near a user's belly button. The tagless size and care instructions label is positioned on the left back leg panel of the short. The mesh inserts are small front panel inserts with a ventilated single-layer, stretchable mesh. The mesh inserts are designed to provide zones of comfort and cooling; a customized design of ventilation that places an emphasis on breathability during intense physical activity. An overlock and cover stitch is used throughout the garment to bind together the elements of the boy short.

The invention in the form of a brief is composed of a memory foam insert, base fabric, elastic band, contrasting trim, and tagless size and care instructions label. The memory foam insert is located within the rear and crotch areas of the brief. The brief is made of a breathable fabric. The elastic band is located at the top of the brief. The brief has a contrasting trim throughout the front and leg areas. The tagless size and care instructions label is positioned at the center of the back panel. An overlock and cover stitch are used throughout the garment to bind together the elements of the brief.

In another embodiment, the invention is comprised of a garment for clothing and other sports apparel or equipment. The invention in the form of a garment would support other parts of the body besides the breasts and gluteals. It consists of a memory foam insert, base fabric, elastic band, contrasting trim, and tagless size and care instructions label. Various other uses for inserting a layer of the foam into clothing and sports apparel or equipment includes football and baseball helmets; shoulder, hip, and rear end pads; shin guards; and athletic supporters.

The present invention seeks to remedy problems seen in earlier support garments, and to provide additional benefits to the wearer. By contouring to the wearer's body, the present invention is able to do so functionally and fashionably.

DRAWINGS—REFERENCE NUMERALS

Figure 1:
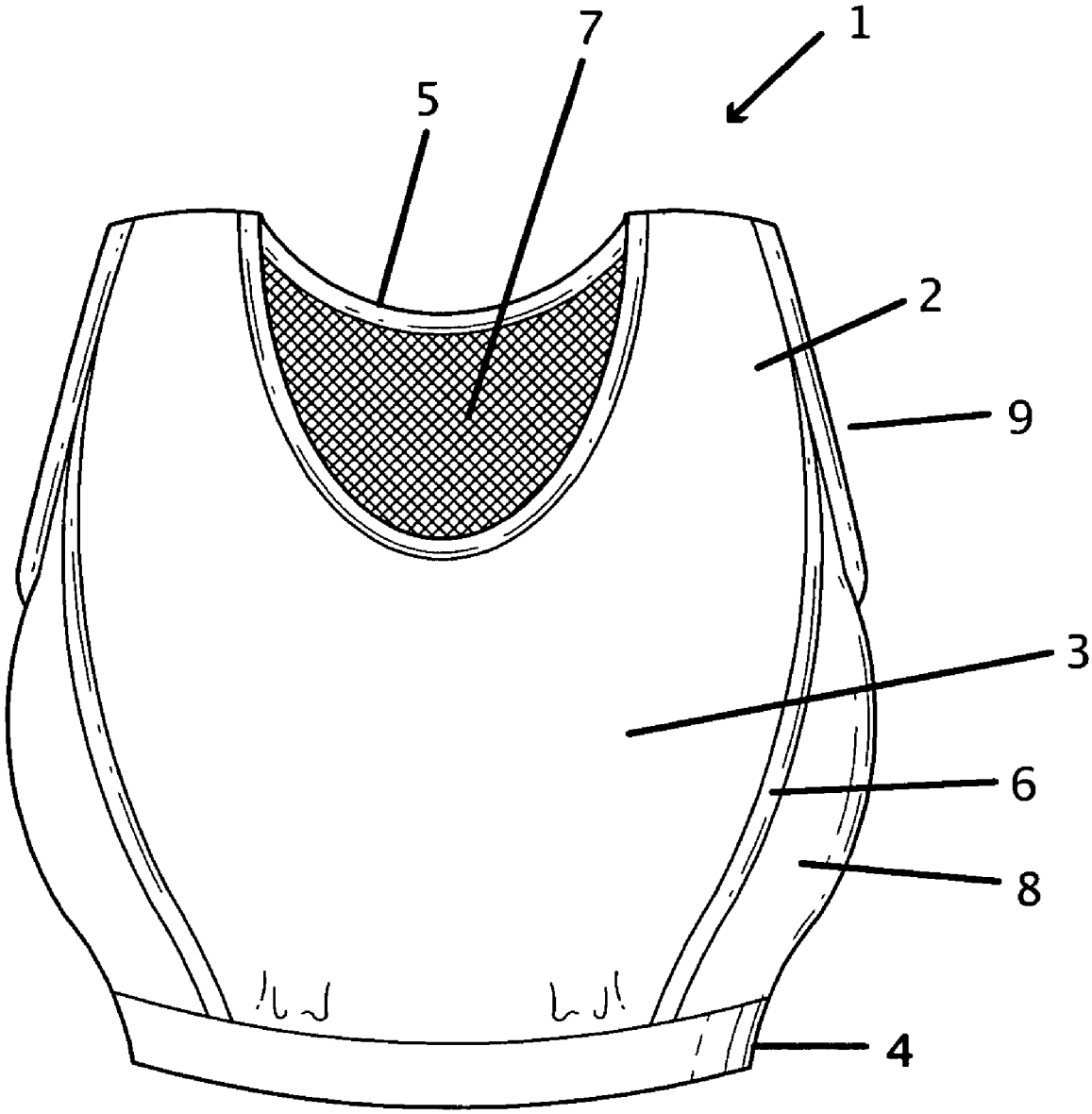
FIG. 1 is a front view of the present invention, in a sports bra embodiment.

1 Invention in bra form
2 Base fabric
3 Memory foam insert
4 Elastic band
5 Ventilated mesh
6 Contrasting trim or binding
7 Tagless size and care instructions label
8 Fabric strip
9 Arm holes

DETAILED DESCRIPTION OF THE DRAWINGS

Referring now to the drawings, there is illustrated an invention in the embodiment of a sports bra according to the present invention, the invention being indicated generally by the reference numeral 1. The invention 1 comprises a base fabric 2 in the front and a mesh fabric 5 in the back. The fabrics 2, 5 are attached to each other by a cover stitch and overlay. The foam insert 3 is located between the layers of fabric 2 on the outside front and fabric strip 8 on the inside sides. There is an elastic band 4 at the bottom and contrasting trim 6 on the front and arm holes 9. A tagless size and care instructions label 7 is located at the top center of the inside mesh 5.

Referring to FIG. 1, it can be seen that the invention 1 is comprised predominantly of a continuous piece of base fabric 2 with contrasting trim 6 on the front and around the arm holes 9. The unique base fabric 2 has UV protection and an antibacterial treatment. The elastic band 4 at the base of the invention 1 is designed for the user's comfort. It is shown as continuing along the continuous bottom edge of the invention 1. The ventilated mesh 5 located at the back of the invention 1 is designed for breathability and comfort of the user. The tagless size and care instructions label 7 is displayed on the inside of the ventilated mesh 5. The foam insert 3 is located on the front of the invention 1, encased inside the base fabric 2. Fabric strip 8 is a matching color fabric on the top seams to cover the foam insert 3. FIG. 1 also shows how the memory foam 3, which covers the entire chest of the wearer, extends substantially around to a front left side 20 and a front right side 21.

Figure 2:
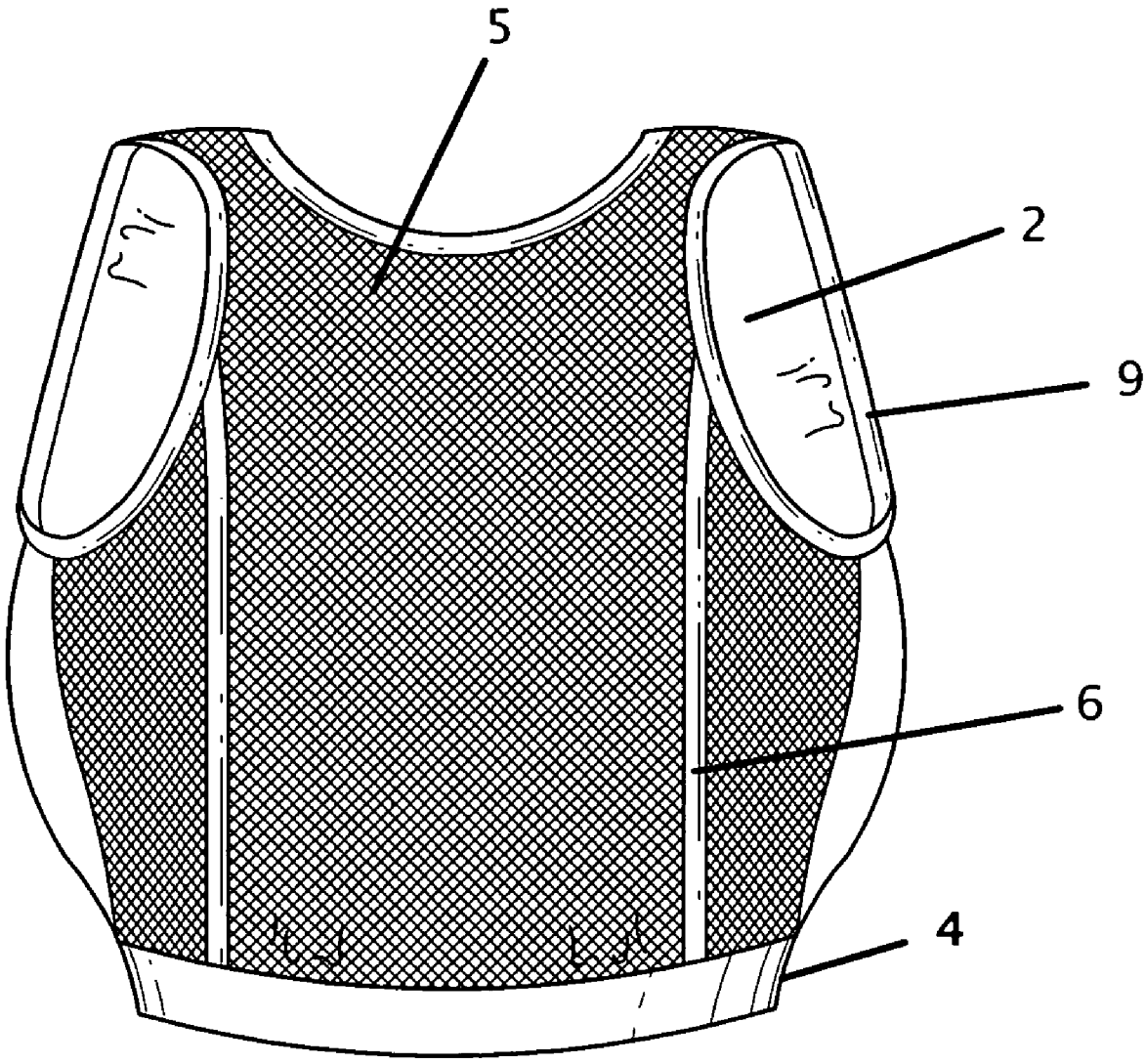
FIG. 2 is a back view of the present invention, in a sports bra embodiment.

Referring to FIG. 2, it can be seen that the invention 1 has a backside composed mainly of a ventilated mesh 5. Contrasting trim 6 is located on the mesh 5 and around the armholes 9. The elastic band 4 is located at the bottom of the invention 1. The base fabric 2 is also located inside the front of the sports bra. Fabric strips 8 are matching color fabric strips on the top and side seams to cover the foam insert. FIG. 2 also shows how the memory foam, which covers the entire chest of the weaver, extends substantially around to a front left side 20 and a front right side 21.

Figure 3:
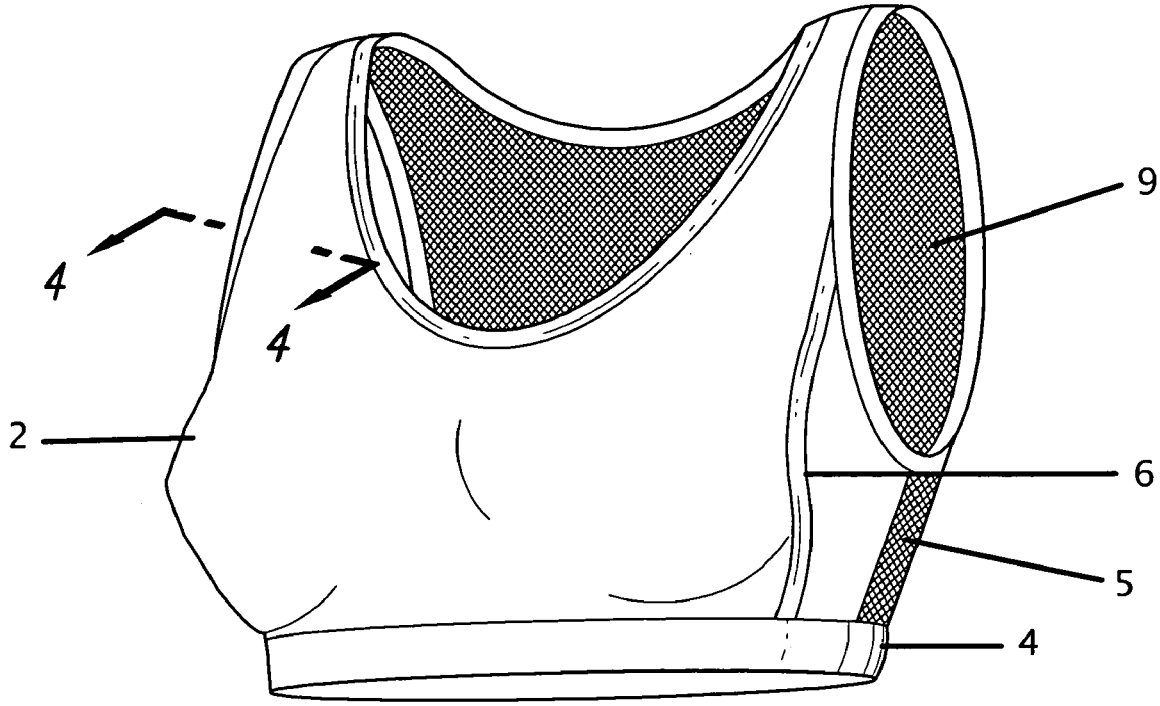
FIG. 3 is a side perspective view of the present invention, in a sports bra embodiment.

Referring to FIG. 3, it can be seen that the invention 1 is comprised mostly of a base fabric 2 on the front and a ventilated mesh 5 on the back. Contrasting trim 6 is located at the neck, arm holes 9 and across the front of the invention 1. An elastic band 4 is located at the bottom of the invention 1.

Figure 4:
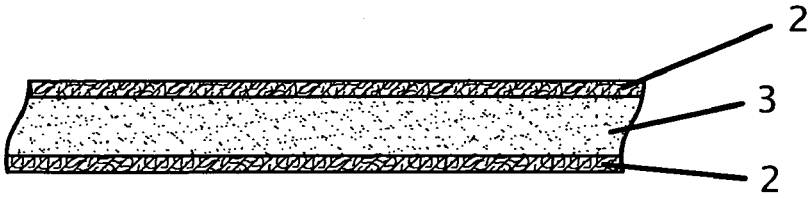
FIG. 4 is a view of the foam layer inside the garment.

Referring to FIG. 4, it can be seen that the memory foam insert 3 is encased between two layers of base fabric 2. The memory foam insert 3 is shown as a cross section of FIG. 3.

Figure 5:
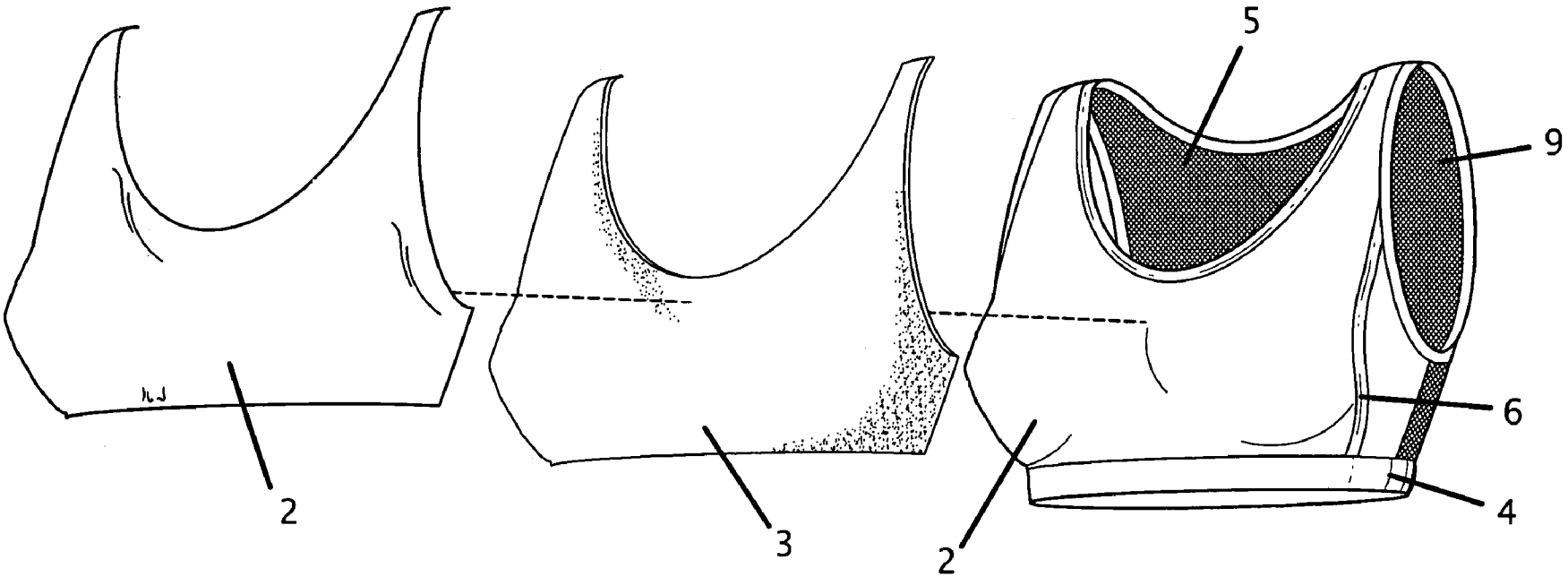
FIG. 5 is an exploded view of the present invention, in a sports bra embodiment.

Referring to FIG. 5, it can be seen that the invention 1 is exploded to show the base fabric 2, foam insert 3 and main body of the invention 1. The foam insert 3 is large enough to cover the breast area and shoulders. Contrasting trim 6 is located at the neck, arm holes 9 and across the front of the invention 1. An elastic band 4 is located at the bottom of the invention 1.

In an alternative embodiment, the invention 1 is in the form of a camisole. The camisole is composed of base fabric 2 with thin shoulder straps, encasing a shelf bra. The shelf bra has the same composition as the above described sports bra.

In an alternative embodiment, the invention 1 is in the form of a boy short. The boy short is composed of a base fabric 2. A memory foam insert 3 is encased within the rear and crotch areas of the boy short, for cushioning and support.

In an alternative embodiment, the invention 1 is in the form of a brief. The brief is composed of a base fabric 2. A memory foam insert 3 is encased within the rear and crotch areas of the boy short, for cushioning and support.

In an alternative embodiment, the invention 1 is in the form of a support garment. The garment is designed to support and conform to the body to minimize bouncing of specific body parts.

Although the present invention has been described with reference to preferred embodiments, workers who are skilled in the art will recognize that changes may be made in form and detail without departing from the spirit and scope of the present invention.

What is claimed is:

1. A supportive undergarment top comprising:

a front portion;

a back portion;

an elastic band; and a stitching portion;

wherein said elastic band is attached to a bottom of said front portion and a bottom of said back portion, encircles a wearer, and provides stabilizing support for a bust of said wearer and provides a controlled fit for said wearer;

wherein said front portion is comprised of a memory foam insert, a base fabric, and a contrasting trim;

wherein said memory foam insert is permanently encased within said base fabric; and wherein said front portion is a single unbroken portion that is an expanse across an entirety of said bust of said wearer;

wherein said stitching portion connects said front portion, said back portion, and said elastic band to each other.

2. The device of claim 1, wherein said front portion extends substantially around a left side and a right side of said supportive undergarment top and provides side comfort and support to said wearer.

3. The device of claim 2, further comprising:

a fabric strip;

wherein said fabric is attached to said base fabric at an inside of said supportive undergarment top;

wherein said fabric strip overlays a plurality of connection seams between said front portion and said back portion; and wherein said fabric strip provides support for said memory foam insert at said plurality of connection seams and prevents said memory foam insert from contacting said user when said supportive undergarment is worn by said user.

4. The device of claim 3, wherein said contrasting trim frames a neck hole, frames a plurality of armholes, and vertically frames a bust area of said front portion.

5. The device of claim 4, wherein said base fabric and said contrasting trim are comprised of a material that provides protection from ultraviolet light and is antimicrobial.

6. The device of claim 5, wherein said stitching portion is comprised of an overlock and a supporting stitch.

* * * * *